United States Patent [19]

Kappner

[11] 3,974,586

[45] Aug. 17, 1976

[54] FIREARMS ACCESSORIES

[76] Inventor: Frank M. Kappner, 4592 Orchard Lane, Cincinnati, Ohio 45236

[22] Filed: Apr. 24, 1975

[21] Appl. No.: 571,068

[52] U.S. Cl. ..... 42/1 S; 33/233

[51] Int. Cl.[2] ..... F41G 1/02

[58] Field of Search ..... 42/1 S; 33/233, 244

[56] References Cited

UNITED STATES PATENTS

| | | | |
|---|---|---|---|
| 2,855,680 | 10/1958 | Christensen | 33/233 |
| 3,299,558 | 1/1967 | Karl | 42/1 S |
| 3,495,338 | 2/1970 | Ullman | 42/1 S |

*Primary Examiner*—Charles T. Jordan

[57] ABSTRACT

A shooter sighting down the rib of a shotgun aligns the front sight, at the end of the rib, with a target using one eye. An improved blinder is described which prevents alignment of the front sight and target from crossing over to the other eye and a resultant missed target. The blinder is detachably mounted on the barrel of a shotgun and comprises an upright portion which is positioned in engagement with one side of the sighting rib rearwardly of the front sight by a pair of spring clips which underlie the rib and grip the barrel. The blinder is formed of spring metal and the inner surfaces of the clips are coated with polytetrafluoroethylene to prevent scratching the finish of the barrel.

2 Claims, 6 Drawing Figures

FIREARMS ACCESSORIES

The present invention relates to improvements in firearm accessories and more particularly to an improved blinder for firearms.

While it is normal practice to aim a firearm, particularly a shotgun, with both eyes open, only one eye can be sighted along the sighting rib, normally mounted on the barrel of the shotgun, to align the front sight, at the end of the barrel, with the target. The eye that is so aimed must dominate over the other eye in focusing on the front sight. It is well recognized that when both eyes are focused on an object in the near field of vision and it is aligned with an object in the far field, on eye is dominant and closing of the dominant eye will change the alignment originally perceived.

Most guns are right handed, meaning that the right eye must be dominant, at least when the gun is aimed. When the right eye is naturally dominant there is little or no problem, but where the dominance of the right eye is not relatively strong, there can be a cross over to the left eye in focusing on the front sight. This will result in a misdirected shot and a missed target.

Where the left eye is dominant, particularly where it is strongly dominant, a person will, in all likelihood, shoot lefthanded. In such case the same problem of cross over can occur, as would also happen where a person shoots lefthanded for other reasons.

An effective solution to the cross over problem is the provision of a blinder, in the form of a thin strip, which extends rearwardly and to one side of the front sight to block it from the non-sighting eye in aiming a shotgun. This strip is conventionally attached, by screws, to one side of the sighting rib of the shotgun and extends above the upper surface of the barrel. The sighting rib is thin, making the mounting of blinders a task requiring a fair degree of care and skill and thus making it relatively expensive.

Blinders have a draw back in that they add further wind blockage to the shotgun barrel. When a strong cross wind is encountered it may be desirable to remove the blinder where the wind drag force on the barrel would have a more adverse effect than the possibility of eye cross over. The small screws employed in fastening the blinder to the rib make its removal and re-attachment tedious, to the end that a person will often shoot with the blinder in place where he would prefer not to do so.

Accordingly one object of the invention is to provide an improved blinder which may be readily and inexpensively attached to the barrel of the firearm.

Another object of the present invention is to provide an improved blinder having the capability of being easily removed after attachment.

Another object of the invention is to attain the above ends with an improved blinder particularly adaptable to shotguns having sighting ribs.

The broader aspects of the invention are found in the blinder having a thin upright portion and means for griping the barrel of the firearm. The griping means position the upright portion lengthwise of the barrel, to one side of and rearwardly of the front sight on the barrel. The upright portion has a height and length sufficient to block the front sight from the view of one eye when the other eye is sighted down the barrel to aim the front sight at a target.

Where the firearm is a shotgun, the griping means of the blinder may take the form of a pair of spring clips spaced along and extending from the lower end of the upright portion. These clips may be curved through an angle of approximately 270° on a diameter slightly less than the diameter of the barrel. The clips may then be telescoped over the end portion of the barrel with the posts which support the sighting rib aligned with the gap between the ends of the clips and the lower end of the upright portion. When the clips are registered with spaces between the posts, the blinder may be rotated to bring the upright portion into abutting relation with one side of the rib. The upright portion is thus positioned for use in aiming the shotgun.

Preferably the blinder is formed of resilient metal, sheet steel being advantageously employed, and the inner surfaces of the gripping means, or spring clips, are coated with polytetrafluoroethylene, or other heat resistant, relatively soft material, to minimize the possibility of scratching the finish on the barrel.

The above and other related objects and features of the invention will be apparent from a reading of the following description of the disclosure, with reference to the accompanying drawings and the novelty thereof pointed out in the appended claims.

Figure 1:
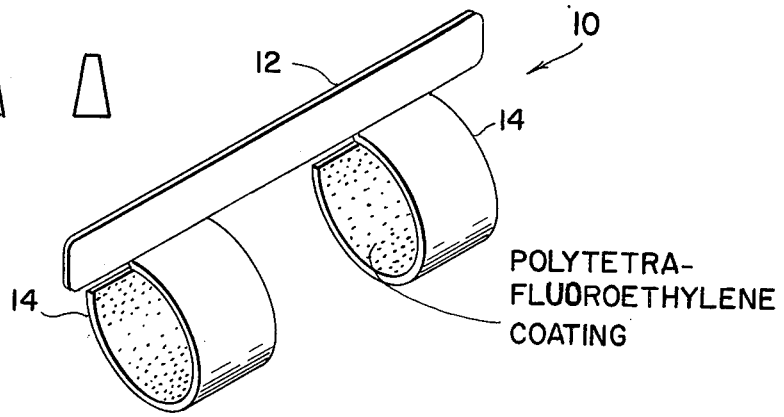
FIG. 1 is a perspective view of a blinder embodying the present invention.

FIG. 1 is a perspective view of a blinder 10 which embodies the present invention. This blinder is a uniquely simple device comprising an upright portion 12 and a pair of spring clips 14.

The blinder 10 is best described with reference to a shotgun barrel 16, FIGS. 2–4, on which it is adapted to be mounted. A sighting rib 18 extends lengthwise of the barrel 16 and is held in angled, spaced relation above its upper surface by posts 20. A front sight 22 is mounted on the upper surface of the rib 18 at the discharge end of the barrel 16. These are conventional elements of a shotgun and common to most, if not all, shotguns.

The spring clips 14 extend from the lower end of the upright portion 12 and are curved on a diameter slightly less than the diameter of the barrel 16, through an angle of approximately 270°. This leaves a gap between the ends of the clips 14 and the lower end of the upright portion 12. This gap is aligned with the sighting rib 18 and the clips 14 telescoped over the front end of the barrel as indicated in FIG. 2. The clips 14 are expanded slightly in being telescoped over the barrel 16 so that they resiliently grip the barrel.

Figure 3:
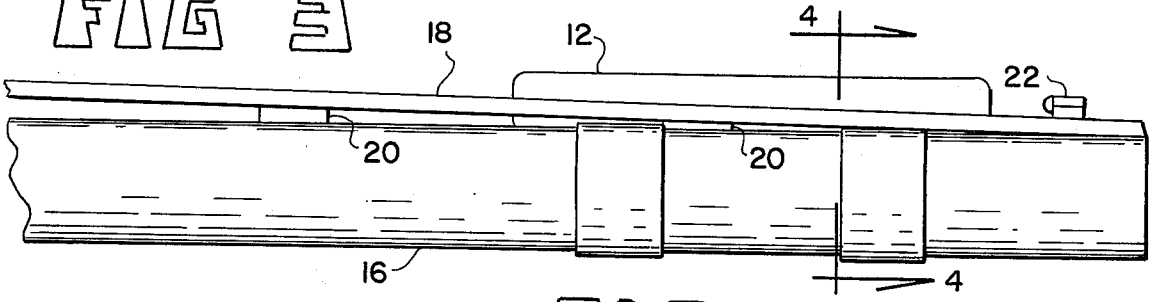
FIG. 3 is a side view of the shotgun barrel with the blinder in place thereon.
Figure 4:
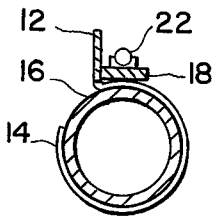
FIG. 4 is a section taken on line 4—4 in FIG. 3.

When the post 20, to the rear of the front sight 22, is registered between the clips 14, the blinder is rotated on the barrel 16 to bring the upright portion 12 into abutting relation with the left-hand side of the sighting rib 18, FIGS. 3 and 4, with the clips 14 underlying the sighting rib 18. The blinder may be shifted lengthwise to bring the front edge of the upright portion into rearwardly spaced relation from the front sight 22. This is desirable so that the upright portion will not cast a shadow on the front sight and which would interfere with aiming.

Figure 6:
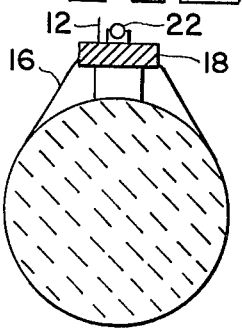
FIG. 6 is a perspective view of the shotgun barrel as seen by the aiming eye when the shotgun is aimed at a target.

With the blinder thus positioned, a right-handed shooter would sight his right eye down the rib 16 to align the front sight 22 with a target. His view would be as indicated in FIG. 6. It will be noted that the upright portion 12 is relatively thin so as to minimize the possibility that the shooters aim would be distracted by the blinder.

Figure 5:
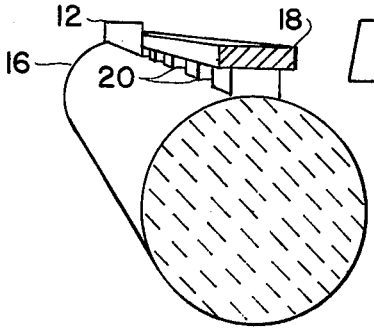
FIG. 5 is a perspective view of the shotgun barrel as seen by the non-aiming eye when the barrel is aimed at a target.

The shooter, when aiming with his right eye, would view the barrel with his left eye as indicated in FIG. 5. The upright portion 12 of the blinder extends lengthwise of the barrel and has a height and length sufficient to block the front sight 22 from the view of his left eye.

Figure 2:
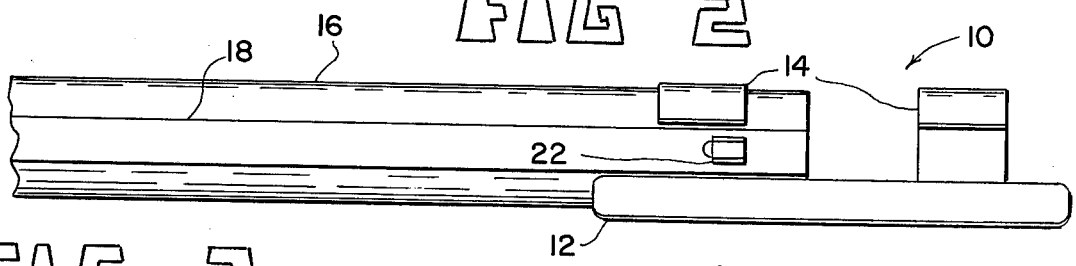
FIG. 2 is a top view of a portion of a shotgun barrel illustrating one step in the attachment of the blinder of the present invention thereto.

For a left-handed shooter the blinder 10 would simply be reversed end-for-end from the position seen in FIG. 2 and then mounted on the barrel in the same fashion, bringing the upright portion into abutting relation with the right side of the sighting rib 18.

The blinder 10 is preferably fabricated of sheet metal, such as spring steel or copper. If metal is used, then it is preferable to coat the inner surfaces of the clips 14 with a relatively soft, heat resistant material, polytetrafluoroethylene being preferred. This coating, available under the trademark Teflon, avoids scratching the finish on the barrel of the shotgun. A preferred metal is spring steel.

The blinder 10 would be dimensioned for a given guage or barrel diameter and will be adaptable for many different models of shotguns of that guage. Some shotguns may, however, require a specially dimensioned blinder due to the peculiarities of its design. Nonetheless, a relatively few sizes of the present blinder will be adaptable to substantially all shotguns.

It will be apparent that the described blinder fulfills the objects of the invention in that it may be readily attached to and removed from the barrel of the shotgun. Further the blinder is economical and there is no modification of the shotgun required to use the present invention.

The blinder of the present invention is also adaptable to other types of firearms. In which case it may not take the exact form disclosed herein, but be modified within the abilities of those skilled in the art. The spirit and scope of the present invention are therefore to be derived from the following claims.

Having thus described the invention, what is claimed as novel and desired to be secured by Letters Patent of the United States is:

1. A blinder for a shotgun type firearm having a barrel and a sighting rib extending along the barrel and held in an elevated position above the upper surface thereof by spaced posts and further having a front sight extending above the upper surface of the sighting rib and positioned generally centrally thereof at the forward end of the barrel, said blinder comprising a thin upright portion, and a pair of spring clips spaced along and extending from the lower end of said upright portion, said clips being curved through an angle of approximately 270° on a diameter somewhat less than the diameter of the barrel, whereby the clips may be telescoped over the end portion of the barrel with the rib supporting posts aligned with the gaps between the ends of the clips and the lower end of the upright portion, said clips being telescoped to a position wherein they are registered with spaces between said posts whereby the blinder may be rotated to bring the upright portion to abutting relationship with one side of the sighting rib, said upright portion having a height and length sufficient to block the front sight from the view of one eye when the other eye is sighted down the barrel to aim the front sight at a target.

2. A blinder as in claim 1 wherein the upright portion and the spring clips are integrally formed of spring steel, and the inner surfaces of the clips are coated with polytetrafluoroethylene.

* * * * *